US009411305B2

(12) United States Patent
Gotoda

(10) Patent No.: US 9,411,305 B2
(45) Date of Patent: Aug. 9, 2016

(54) IMAGE FORMING APPARATUS WITH STRUCTURAL CONNECTION FUNCTION

(71) Applicant: Avision Inc., Hsinchu (TW)

(72) Inventor: Katsuhiko Gotoda, Hsinchu (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/337,845

(22) Filed: Jul. 22, 2014

(65) Prior Publication Data

US 2015/0268625 A1 Sep. 24, 2015

(30) Foreign Application Priority Data

Mar. 24, 2014 (TW) ..... 103204978 U

(51) Int. Cl.
*G03G 21/16* (2006.01)
*G03G 21/18* (2006.01)

(52) U.S. Cl.
CPC ..... *G03G 21/1676* (2013.01); *G03G 21/1821* (2013.01)

(58) Field of Classification Search
CPC ..... G03G 21/1821
See application file for complete search history.

(56) References Cited

U.S. PATENT DOCUMENTS

| | | | | |
|---|---|---|---|---|
| 4,975,746 | A * | 12/1990 | Miyauchi et al. | 399/111 |
| 2002/0028088 | A1* | 3/2002 | Okabe et al. | 399/113 |
| 2004/0096240 | A1* | 5/2004 | Kim | 399/222 |
| 2005/0053394 | A1* | 3/2005 | Ishii et al. | 399/111 |
| 2006/0056876 | A1* | 3/2006 | Okabe et al. | 399/113 |
| 2007/0264045 | A1* | 11/2007 | Okabe et al. | 399/113 |
| 2011/0002709 | A1* | 1/2011 | Sato | 399/119 |
| 2013/0051851 | A1* | 2/2013 | Fukamachi | 399/113 |

* cited by examiner

*Primary Examiner* — David Gray
*Assistant Examiner* — Sevan A Aydin

(57) ABSTRACT

The present disclosure illustrates an image forming apparatus with structural connection function. The image forming apparatus can be applied to a business machine, to solve the problem of bad quality of image caused by shaking of a developing module. The image forming apparatus is characterized in that the groove with the inclined angle is equal to the pressure angle of the gear to constrain the operation direction of the developing module, so as to prevent the developing module from shaking. The present disclosure just modifies the design of the guiding channel to constrain the developing module, so the cost of components can be reduced efficiently.

6 Claims, 3 Drawing Sheets

IMAGE FORMING APPARATUS WITH STRUCTURAL CONNECTION FUNCTION

CROSS-REFERENCE TO RELATED APPLICATION

This application claims the benefit of Taiwan Patent Application No. 103204978, filed on Mar. 24, 2014, in the Taiwan Intellectual Property Office, the disclosure of which is incorporated herein in its entirety by reference.

BACKGROUND OF THE INVENTION

1. Field of the Invention

The present disclosure relates to an image forming apparatus with structural connection function, in particular, to an image forming apparatus applied to a business machine to solve the problem of bad quality of the image due to shaking of a developing module.

2. Description of the Related Art

At present, the image forming apparatus of the business machine utilizes a developing roller to transfer the toner on an organic photo conductor to develop the image, and the organic photo conductor then transfers the toner on the printing media. During the developing process, the driving gear of the organic photo conductor engages with the slave gear of the developing roller for simultaneous rotation, so that the developing roller can coat the toner on the surface of the organic photo conductor. However, when these gears are engaged, a moment is transmitted along the pressure angle and shakes the developing roller, which results in the problem of bad quality of the formed image.

To solve this problem, in the prior art, an all-directional connector is applied to connect the organic photo conductor and the developing roller for image developing, so the force is not transmitted by the set of gears and the above-mentioned problem can be solved. However, the manufacturing cost of the image forming apparatus is increased because of the complex structure and high cost of the all-directional connector.

In addition, in the prior art, gear series are used to engage and constrain each other. However, the gear series also increases the cost and occupies more space, so it is not easy for miniaturization and cost down.

SUMMARY OF THE INVENTION

To solve the problem in the prior art, one of the objectives of the present disclosure is to provide an image forming apparatus with structural connection function. The image forming apparatus utilizes a groove with an inclined angle equal to a pressure angle of the gear, to constrain an acting range of the developing module and to balance the carry-over moment while the driving gear is rotating, so the developing module can be prevented from shaking.

Another objective of the present disclosure is to provide an image forming apparatus with structural connection function. The guiding channel of the image forming apparatus is redesigned to constrain the developing module, so that the cost of components can be reduced efficiently.

An exemplary embodiment of the present disclosure provides an image forming apparatus with structural connection function, which comprises a base, a photosensitive drum, and a developing module. Two sides of the base are provided with corresponding guiding channels respectively, and each of the guiding channels includes a mounting groove and a constrained straight groove. The mounting groove is located at an opening end of constrained straight groove, and the constrained straight groove has a groove with an inclined angle. The photosensitive drum is located inside the base. The developing module is movably placed in the guiding channel, and the developing module comprises a developing box and a developing roller. The developing roller is mounted on the developing box, and the driving gear of the photosensitive drum is engaged with the developing gear of the developing roller for driving. The inclined angle is equal to a pressure angle of the driving gear of the photosensitive drum, and the constrained straight groove is located on a normal direction of the pressure angle to constrain an acting range of the developing module.

Preferably, two ends of an axle of the developing roller are provided with a rotation element respectively, and an outer diameter of the rotation element is equal to or smaller than a width of the constrained straight groove.

Preferably, the rotation element comprises a bearing, a roller, or the combination thereof.

Preferably, the mounting groove is arranged to dismount or mount the developing module.

Preferably, an action line between the driving gear of the photosensitive drum and the developing gear of the developing roller is horizontal.

Preferably, the imaging forming apparatus according to the present disclosure further comprises an adjusting member located between the base and the developing module. The adjusting member comprises an elastic element and an adjusting element to adaptively adjust contact degree between the photosensitive drum and the developing roller, so as to maintain stable contact between the photosensitive drum and the developing roller.

The image forming apparatus with structural connection function provided in the present disclosure has the following advantages.

The first advantage is cost saving. The original assembly is redesigned by modifying the inclined angle of the guiding channel to equal to the pressure angle, so the modified structure can be used to connect and constrain the developing module, and the cost of components can be saved efficiently.

The second advantage is ensuring of the quality of image developing. After the developing module is mounted and fixed, the acting range of the developing module can be constrained effectively and the developing module is not easily shaken, so that the quality of the developing can be ensured.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
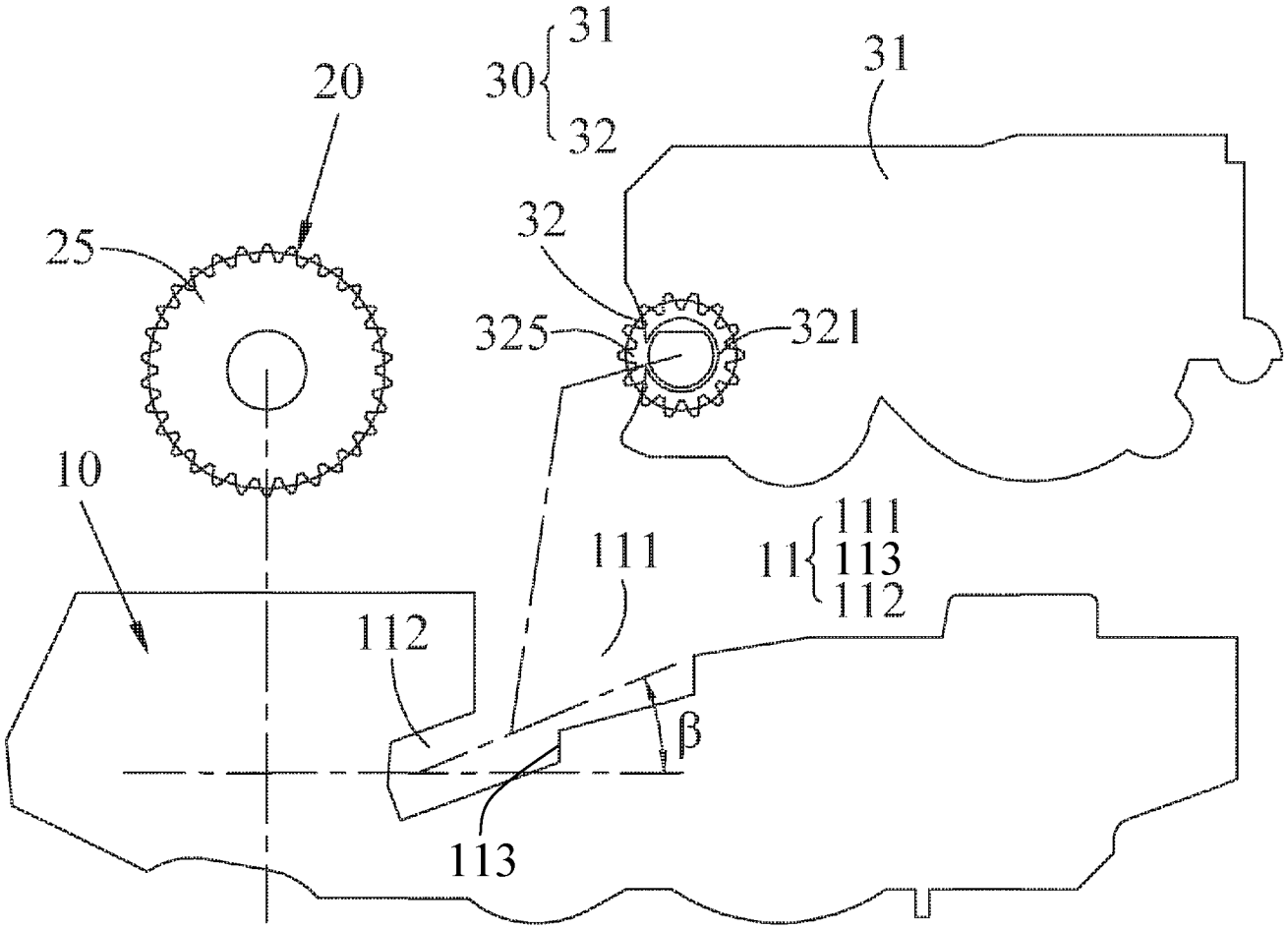
FIG. 1 is an exploded view of an image forming apparatus with structural connection function according to the present disclosure.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

Figure 2:
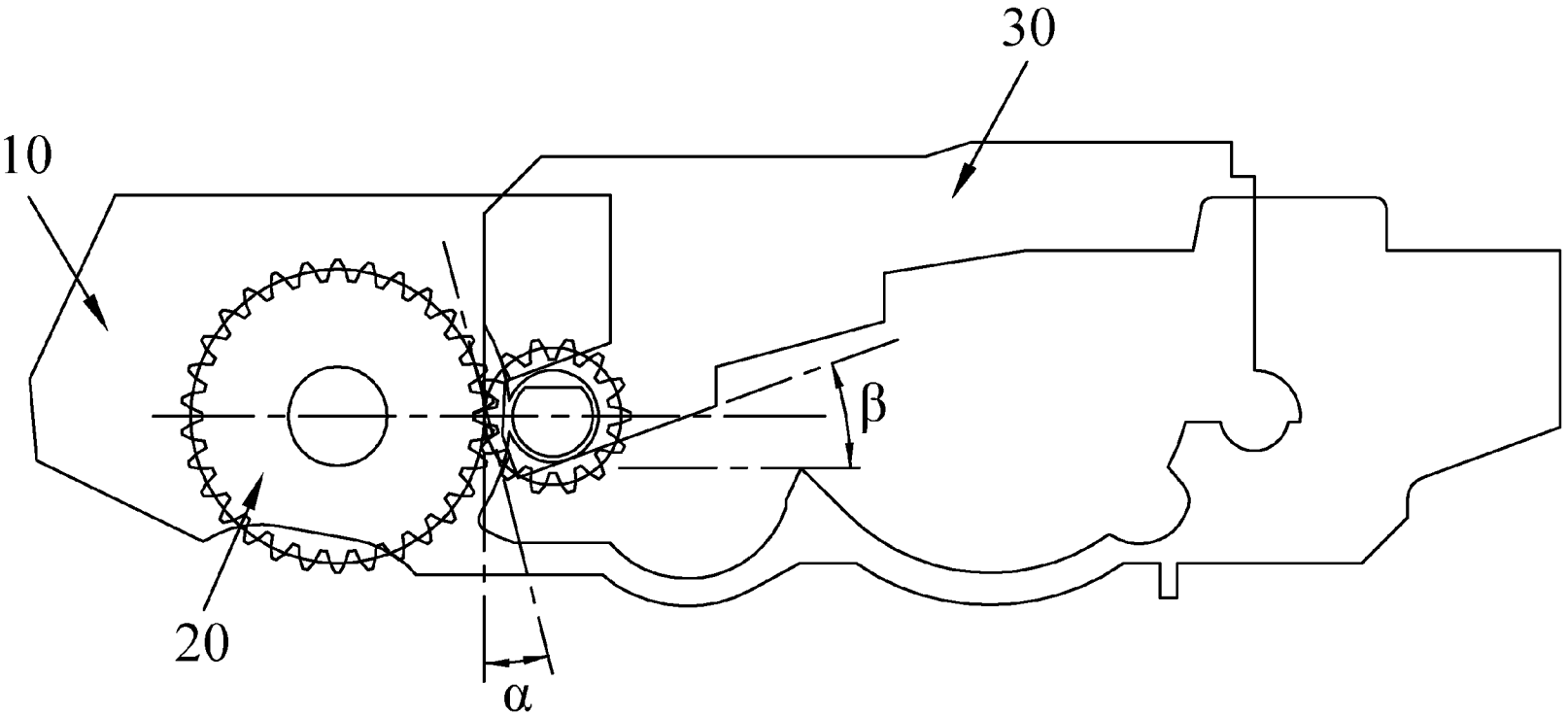
FIG. 2 is a combined view of the image forming apparatus with structural connection function according to the present disclosure.

Please refer to both of FIG. 1 and FIG. 2, the image forming apparatus with structural connection function is mounted inside a business machine, such as a printer, a copying machine or a multi-function printer. The image forming apparatus comprises a base 10, a photosensitive drum 20 and a developing module 30. In implementation, the base 10 is a main structure or a body member of the business machine. Each of two sides of the base 10 is provided with a corresponding guiding channel 11.

Each guiding channel 11 comprises a mounting groove 111 and a constrained straight groove 112. The mounting groove 111 is located on an opening end of the constrained straight groove 112, so that the developing module 30 can be movably and smoothly assembled or disassembled for repairing. The constrained straight groove 112 is a groove with inclined angle β. The photosensitive drum 20 is disposed inside the base 10, and the developing module 30 is movable disposed in the guiding channel 11.

The developing module 30 comprises a developing box 31 and a developing roller 32. The developing box 31 is configured for storing the toner or other developing coatings. The developing roller 32 is mounted on the developing box 31, located opposite to the photosensitive drum 20 and contacts with the photosensitive drum 20. The driving gear 25 of the photosensitive drum 20 is engaged with the developing gear 325 of the developing roller 32. When the driving gear 25 of the photosensitive drum 20 rotates, the developing gear 325 of the developing roller 32 is driven by the engagement with the driving gear 25 to rotate simultaneously for developing.

For further illustration, the photosensitive drum 20 and the driving gear 25 are coaxial, and the developing roller 32 and the developing gear 325 are also coaxial. A power source not shown in figure inputs power to the driving gear 25 to engagedly drive the developing gear 325 and rotate the developing roller 32.

Each of two ends of the axle of the developing roller 32 is provided with a rotation element 321, for smoothly assembling the developing module 30 along the guiding channel 11. The outer diameter of the rotation element 321 is equal to or smaller than the width of the constrained straight groove 112. The rotation element 321 is a rotating contact element, such as a bearing or a roller.

An action line between the driving gear 25 of the photosensitive drum 20 and the developing gear 325 of the developing roller 32 is horizontal. The inclined angle β of the constrained straight groove 112 is equal to the pressure angle α of the driving gear 25 of the photosensitive drum 20. The constrained straight groove 112 is located on the normal direction of the pressure angle α. When the developing module 30 is glided along the constrained straight groove 112 to contact the photosensitive drum 20, the acting range of the developing roller 32 is constrained by engagement between the driving gear 25 and the developing gear 325.

In more detail, when the inclined angle β of the constrained straight groove 112 is lower than the pressure angle α ($\beta<\alpha$), the developing module 30 is moved upward by just little upward force, and the quality of forming image is affected correspondingly.

If the inclined angle β of the constrained straight groove 112 is larger than the pressure angle α($\beta>\alpha$), it is easy to generate interference between the driving gear 25 of the photosensitive drum 20 and the developing gear 325 of the developing roller 32, so the grind of the gear increases. In addition, when the inclined angle β is too large, the gear interference will affect the smooth assembly.

The inclined angle β of the constrained straight groove 112 according to the present disclosure is modified to equal to the pressure angle α($\beta=\alpha$). The shaking range of the developing roller 32 can be constrained by the structural connection, so the quality of image development can be ensured. Therefore, the problem that developing roller 32 shakes during the developing process can be solved efficiently by just modifying the inclined angle β, and the cost of designing, manufacturing and assembling the elements can also be reduced efficiently.

In this embodiment, as shown in FIG. 1, the guiding channel 11 can comprise a vertical surface 113. The mounting groove 111 and the constrained straight groove 112 are respectively connected to two sides of the vertical surface 113 that are opposite to each other.

Figure 3:
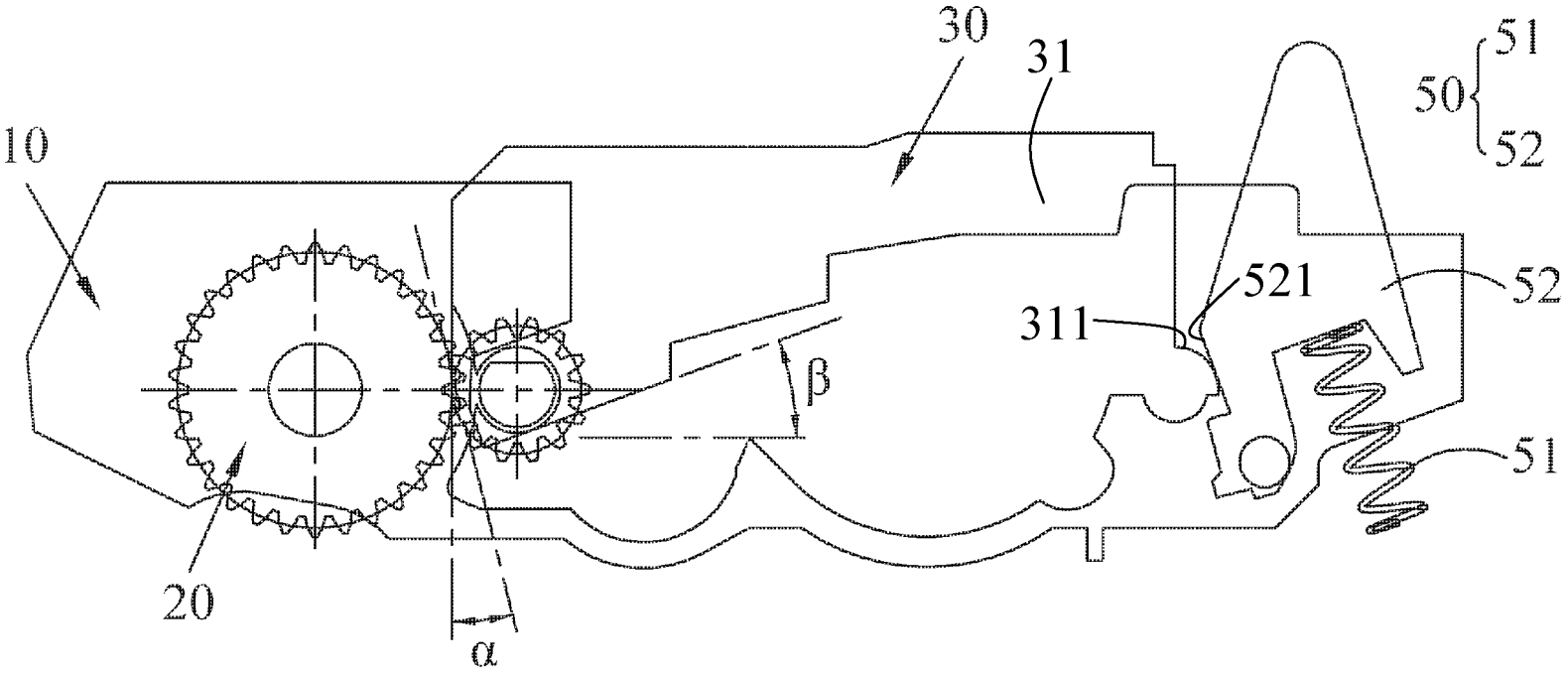
FIG. 3 is a schematic view of an exemplary embodiment of the image forming apparatus with structural connection function according to the present disclosure.

Please refer to FIG. 3, after the business machine is operated for a period, the toner contained inside the developing module 30 will be reduced gradually and it causes change of weight of the developing module 30, so the contact degree between the photosensitive drum 20 and the developing roller 32 is also changed correspondingly. In this case, although the developing roller 32 can be constrained by the constrained straight groove 112, the problem of assembly margin or components grind still causes the developing roller 32 to shake a little.

To solve the problem, the image forming apparatus with structural connection function according to the present disclosure further comprises an adjusting member 50 which is located between the base 10 and the developing module 30 and comprises an elastic element 51 and an adjusting element 52 to adjust adaptively the contact degree of the photosensitive drum 20 and the developing roller 32, to ensure the quality of forming image of the business machine.

In this embodiment, the developing box 31 of the developing module 30 can have a quarter-circular surface 311, and the adjusting element 52 can have a flat surface 521 facing the quarter-circular surface 311. The quarter-circular surface 311 is abutted against the flat surface 521.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. An image forming apparatus with structural connection function, comprising:

a base, each of two sides of the base being provided with a guiding channel, and each of the guiding channels including a mounting groove and a constrained straight groove, the mounting groove located at an opening end of the constrained straight groove, and the constrained straight groove having a groove with an inclined angle;

a photosensitive drum, placed in the base; and a developing module, movably placed in the guiding channel, and the developing module comprising a developing box and a developing roller, and the developing roller mounted on the developing box, and a driving gear of the photosensitive drum engaged with a developing gear of the developing roller for driving;

wherein, the inclined angle is equal to a pressure angle of the driving gear of the photosensitive drum, and the constrained straight groove is located on a normal direction of the pressure angle to constrain an acting range of the developing module;

wherein, each of the guiding channels further comprises a vertical surface for positioning the developing roller in the constrained straight groove, the mounting groove and the constrained straight groove are respectively connected to two sides of the vertical surface that are opposite to each other.

2. The image forming apparatus according to claim 1, wherein the mounting groove is arranged to dismount or mount the developing module.

3. The image forming apparatus according to claim 1, wherein each of two ends of an axle of the developing roller is provided with a rotation element, and an outer diameter of the rotation element is equal to or smaller than a width of the constrained straight groove.

4. The image forming apparatus according to claim 3, wherein the rotation element comprises a bearing, a roller, or a combination thereof.

5. The image forming apparatus according to claim 1, wherein an action line between the driving gear of the photosensitive drum and the developing gear of the developing roller is horizontal.

6. The image forming apparatus according to claim 1, further comprising an adjusting member, the adjusting member located between the base and the developing module and comprising an elastic element and an adjusting element to adaptively adjust contact degree between the photosensitive drum and the developing roller, so as to maintain stable contact between the photosensitive drum and the developing roller;

wherein, the developing box has a quarter-circular surface, the adjusting element has a flat surface facing the quarter-circular surface, and the quarter-circular surface is abutted against the flat surface.

* * * * *